US006389636B1

(12) United States Patent
Savill

(10) Patent No.: US 6,389,636 B1
(45) Date of Patent: May 21, 2002

(54) TOOTHBRUSH

(75) Inventor: Derek Guy Savill, Bebington (GB)

(73) Assignee: Unilever Home & Personal Care USA, Co, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/491,950

(22) Filed: Jan. 26, 2000

(30) Foreign Application Priority Data

Jan. 29, 1999 (GB) ..... 9902080

(51) Int. Cl.[7] ..... A46B 9/04
(52) U.S. Cl. ..... 15/167.1; 15/105; 116/212
(58) Field of Search ..... 15/105, 167.1, 15/201; 116/200, 201, 208, 212; 434/263

(56) References Cited

U.S. PATENT DOCUMENTS

| | | | | | |
|---|---|---|---|---|---|
| 2,882,544 | A | * | 4/1959 | Hadidian | 16/167.1 |
| 2,935,755 | A | * | 5/1960 | Leira et al. | 15/167.1 |
| 3,224,316 | A | * | 12/1965 | Grikscheit et al. | 116/212 X |
| 3,493,991 | A | * | 2/1970 | De Bianchi | 15/143.1 |
| 4,698,869 | A | | 10/1987 | Mierau et al. | 15/22.1 |
| 4,716,614 | A | | 1/1988 | Jones et al. | 15/105 |
| 4,744,124 | A | | 5/1988 | Wang et al. | 15/105 |
| 5,115,533 | A | * | 5/1992 | Hukuba | 15/105 |
| 5,282,291 | A | | 2/1994 | Spieler et al. | 15/167.1 |
| 5,315,732 | A | * | 5/1994 | Huefner et al. | 15/167.1 |
| 5,355,544 | A | | 10/1994 | Dirksing | 15/105 |
| 5,876,207 | A | | 3/1999 | Sundius et al. | 433/216 |

FOREIGN PATENT DOCUMENTS

| | | | | |
|---|---|---|---|---|
| GB | 2236071 | * | 3/1991 | |
| JP | 6-245815 | * | 9/1994 | 15/167.1 |
| WO | 99/05935 | | 2/1999 | |

* cited by examiner

*Primary Examiner*—Mark Spisich
(74) *Attorney, Agent, or Firm*—Milton L. Honig

(57) ABSTRACT

A toothbrush incorporates an indicator comprising a pressure indicating material which provides an optical signal without the provision of a power supply and wherein the signal is provided when the correct brushing pressure is being applied. Preferably, the pressure sensitive material is a piezochromic material, such as a liquid crystal cholesterol ester.

12 Claims, 3 Drawing Sheets

TOOTHBRUSH

BACKGROUND OF THE INVENTION

1. Field of the Invention

This invention relates to a toothbrush, and in particular to a toothbrush which incorporates a device to indicate to the user that a suitable force is being applied during brushing.

2. The Related Art

It is widely appreciated that people cause serious damage to their teeth and gums by brushing too hard, and there have been a number of designs of toothbrush aimed at overcoming this problem. Several studies have arrived at the conclusion that excessive pressure during brushing leads to recession on premolars, and also gingival recession, which exposes the underlying cementum, often leading to hypersensitivity, loss of aesthetics, and may be a factor in root caries and root surface abrasion, leading to root fillings.

One solution is a brush which simply will not transmit excessive force, for example a design disclosed in DE 3 724 476 (Schliebs) where the neck of the toothbrush buckles if the user attempts to brush too hard. This, however, may result in a relatively flimsy product, which may be frustrating to use, as brushing may continually be interrupted. Another known solution is disclosed in U.S. Pat. No. 5,502,861 (Bioware) which provides a toothbrush with an indicator which signals to the user if excessive force is being applied. This has the advantage that the user is provided with a clear signal that brushing is too hard, and which can be used to learn to brush correctly. It is disclosed in U.S. Pat. No. 5,282,291 (Bioware) that it is thought preferable to make the indicator mechanism an integral part of the brush, rather than an attachment to it; the latter arrangement generally results in a brush which is awkwardly shaped and unnatural to use. Known designs incorporating integral indicators generally use an electrical circuit of some kind. In the design disclosed in U.S. Pat. No. 5,282,291, components of the circuit are brought into contact as the brush flexes, completing the circuit and triggering the indicator. Often, the user must fit a battery to power the indicator, which due to the limited size of the brush must be small and is, therefore, tricky to fit. In designs where a battery is required, access to the circuitry must be available, for example through a removable cover. This arrangement is inevitably less hygienic: the cover is unlikely to fit exactly flush with the handle surface and debris may collect in any gap between the cover and handle and also in the cavity itself. The device disclosed in DE 3 724 476 avoids the problem of powering the indicator circuit by relying instead on a piezoelectric component to act as a 'mechanical-electrical convertor' producing an electrical signal in response to the applied force. Obviously, these designs require a number of miniature components fitted into a small cavity in the brush handle, which is likely to render them difficult and therefore expensive to manufacture. Also, it is not ideal to locate a battery in a persistently damp environment, especially if it has to be replaced from time to time. These disadvantages can be overcome by the use of an indicator which does not require a separate power source or complex circuitry and can be incorporated easily into the body of the brush.

Our co-pending application PCT/EP98/04998 discloses a brush comprising a piezochromic element which indicates when a safe brushing pressure has been exceeded.

There is, therefore, a need for a brush which positively indicates to the user that the correct brushing pressure is being used as opposed to informing him when too much pressure has been applied.

SUMMARY OF THE INVENTION

Thus, according to a first aspect of the invention there is provided a toothbrush incorporating an indicator comprising a pressure indicating material which provides a signal without the provision of a power supply, such as a battery or the electricity mains, characterised in that the indicator is capable of providing the signal when a suitable brushing pressure is being or has been applied.

Thus, the user can be provided with a positive, indication when a suitable brushing force is being or has been used.

In a preferred embodiment the signal is provided when a suitable brushing pressure is being applied and is absent when brushing pressure is too high.

Preferably, the pressure signal is a signal, especially an optical signal, which indicates to the user when a suitable brushing pressure is being applied, but then may relax to its original state, e.g. colour or illumination, after a period of time. This may or may not be after the user has finished a normal brushing regime. As such, the relaxation time of the material providing the optical response may typically be in the region of 1 second to 24 hours, though it is preferably long enough for the user to register it, and is preferably less than 24 hours. More preferably, the relaxation time for the pressure indicating material is between 1 second and 10 minutes and especially between 1 second and 5 seconds.

Although the preferred signal is an optical signal it is also envisaged that the signal may be an audible or mechanical signal. For example, a suitable audible signal may be music or a buzzer, while a suitable mechanical signal may be a vibration.

Where the signal is an optical signal it is preferred that the pressure indicating material is a piezochromic material.

The pressure indicating material according to the invention, which is preferably a piezochromic material, is a material susceptible to show an optical response upon the application of pressure.

Such piezochromic materials include molybdenum carbonyl, which is susceptible to changes in solvent polarity upon the application of pressure resulting in a change in colour.

In a preferred embodiment the pressure indicating material is a shear sensitive material, for example a liquid crystal or a liquid crystal blend.

The pressure indicating material may also be a material susceptible to conformational changes or structural rearrangements upon the application of pressure, for example, crystals of toluene sulphonate diacetylene polymers; or copolymers containing poly(diacetylenes) or poly (silylenes). Again, the pressure indicating material may be one susceptible to relative changes in refractive index upon the application of pressure, for example aromatic solvents containing poly(N-methyl acrylamide).

According to this invention the indicator is capable of providing a signal when brushing pressure is being or has been applied and is absent when brushing pressure is too high. Thus it is an essential feature of the invention that the pressure indicating material is so calibrated to be capable of providing such a signal. An example of such calibration for a brush comprising a piezochromic material may be the presence of only a certain amount of the active shear sensitive material or the inclusion of an additional material, such as a polymer, which may act as a signal modifier, e.g. by changing the viscosity of the crystals, which will prevent a signal being provided if the brushing pressure is too high.

It is also envisaged that the signal provided on application of a correct brushing pressure may be graduated to reflect changes in brushing pressure within the suitable range. For example, where the indicator provides an optical signal is possible that the optical signal may vary with dependence upon the changes of the brushing pressure, e.g. the signal may be green when brushing pressure is optimal; amber when pressure is sub-optimal but acceptable and red when pressure is approaching an unacceptable level. The signal would, of course, disappear when the correct pressure is no longer being applied. In a similar way the optical signal may involve the illumination of a single bulb and the degree of illumination may dim when the brushing pressure approaches levels which are not correct.

In another embodiment, the pressure indicating material may be one triggered to respond as a result of the pressure sensitivity of another material. For example, the pressure indicating material may be a thermochromic material susceptible to a variation in temperature brought about by conduction from a further material having a temperature which varies in dependence upon the pressure applied thereto.

In yet another embodiment, the pressure indicating material may be one susceptible to a variation in electric current generated by a piezoelectric material. In this case, the pressure indicating material will display an optical response brought about by a further material having an electrical property which varies in dependence upon the pressure applied thereto.

In an alternative aspect of the invention the pressure indicating material is activated not by the process of brushing but by the user's grip. A strong grip may be suggestive of an aggressive brushing style which may damage the gums. Thus the indicating material may be incorporated so as to provide a signal when the user's grip is within a range which corresponds to a correct brushing pressure.

A further essential feature of the invention is that the indicator is powered without the provision of a power supply. In embodiments where the brush additionally comprises an integrated electrical circuit to regulate the provision of a signal it is envisaged that the circuit receives its electricity from a solar cell, a dynamo, such as is found in hand powered torches or kinetic watches, or suchlike.

In a preferred embodiment, the piezochromic material is a liquid crystal cholesterol ester. Such a material is commercially available from Hallcrest Liquid Crystal Technology Ltd, Unit 9, Stepnell Reach, 541 Blandford Road, Hamworthy, Poole, Dorset BH16 5BW. Many mixtures are available which differ in colour and physical characteristics. Examples include the CN series, e.g. CN/R1, CN/R2, CN/R3 and CN/G1 which comprise a mixture of cholesteric liquid crystals such as cholesteryl nonanoate, cholesteryl chloride, cholesteryl oleyl carbonate, cholesteryl 2,4 dichlorobenzoate.

It is envisaged that any suitable mixture of shear sensitive liquid crystal cholesteryl esters may be used in this invention.

Liquid crystal cholesteryl esters display an optical response (a colour change) within the range of pressure generated by brushing, and is not affected by the range of temperature to which a brush is normally subjected. A further advantage is that this material can relax to its original state reasonably quickly. An indicator substance which requires a period of days to recover would not be suitable for the present application. It has, however, been found useful to use a material for providing the optical response which demonstrates a degree of hysteresis.

It is envisaged that the relaxation period of the indicator material may be such that it can be seen when the correct brushing pressure is being or has been exceeded during brushing, i.e. the signal disappears as soon as the correct pressure is no longer being applied.

The relaxation period may be so short that changes in brushing technique are quickly represented by the indicator material and several changes in brushing technique may be made.

In the known designs, a separate mechanism is used to trigger the indicator, for example a predetermined flexure of the brush or movement of the bristles causes two components to move relative to each other and to close an electrical circuit. In a preferred embodiment of the invention, the need for such a mechanism is avoided, as the force exerted on the brush is communicated directly to the indicator.

Less costly embodiments use a small amount of the pressure indicating material located in a pad, plate or bubble located in/on the brush head, in/on the main body of the brush, or in/on the bristles. By way of example, the optical indicator (e.g. piezochromic) material can be heat sealed into a vinyl envelope, or it can be otherwise encapsulated. Two plates of the pressure indicating material may be used, which plates are squashed together by an applied force. In one example, plates of the material are interleaved with the brush bristles. Pressure applied to the bristles causes bending of the bristles as well as the plates. In an alternative embodiment, the material is formed into a resilient membrane located at the base of the bristles, with the brush head preferably being transparent to allow the pressure indicating material to be visually inspected.

In another preferred embodiment, a mechanical arrangement is provided to transmit the force to the indicator. For example, the brush may have two handle sections linked by a pivot, a portion of one of these sections extending beyond the pivot into a cavity provided in the other section. Excessive pressure causes the two sections to rotate relative to each other, in opposite directions about the pivot, such that one face of the extended portion will be brought into contact with the inner surface of the cavity in which it is located. That interior surface is provided with a pad of the pressure indicating material. Designs such as this, which employ moving elements to transmit the applied force to the indicator, have the advantage that the force may be amplified or reduced to fall within the response range of the pressure indicating material.

With regard to the other parts of the brush, the brush body may be made of materials and with methods used in the art, for example using injection moulding techniques and materials such as polypropylene and polymethyl methacrylate. The bristles may be made of materials which are used in the art, including nylon and poly butylterephthalate.

BRIEF DESCRIPTION OF THE DRAWING

The invention will now be described in greater detail, by way of example, with reference to the following figures.

DETAILED DESCRIPTION OF THE INVENTION

Figure 1:
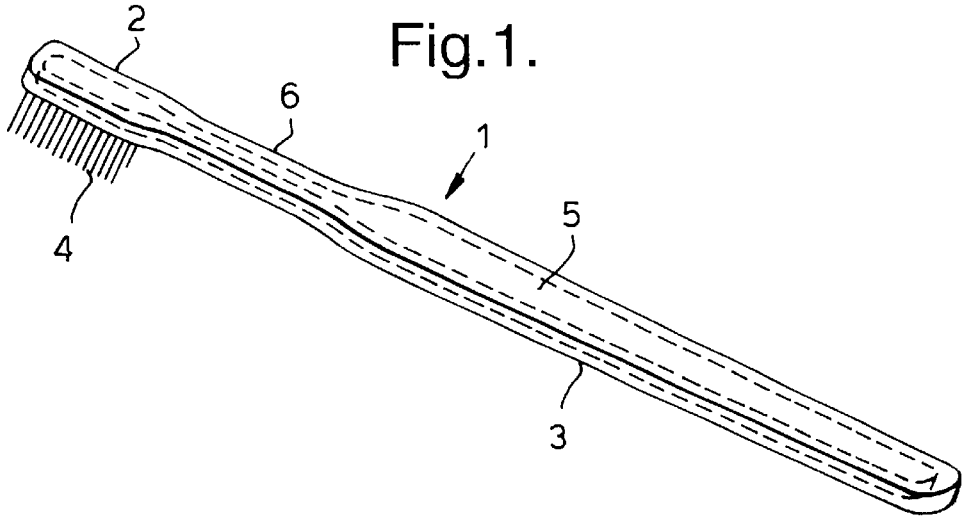
FIG. 1 is a perspective view of a first embodiment of the invention showing a brush having an internal cavity which is completely filled with piezochromic material.

Referring to the drawings, FIG. 1 shows a toothbrush 1 having a head 2 integrally formed with a handle 3 via a neck. The head 2 is provided with bristles 4 made of nylon. The head 2 and handle 3 are made of a resilient transparent material such as polymethyl methacrylate and define a cavity 5 extending substantially along the entire length of the brush 1. The cavity 5 is filled with a piezochromic material, e.g. a liquid crystal cholesterol ester. A predetermined pressure (suitable for brushing teeth) applied to the bristles 4, or a predetermined flexure of the handle 3, will be transmitted to, and thereby cause an optical response (such as a change of colour) of, the piezochromic material. The cavity 5 may, instead of extending substantially the entire length of the brush 1, be more localised, for example, it may be confined to a neck region 6 joining the handle 3 to the head 2.

Figure 2:
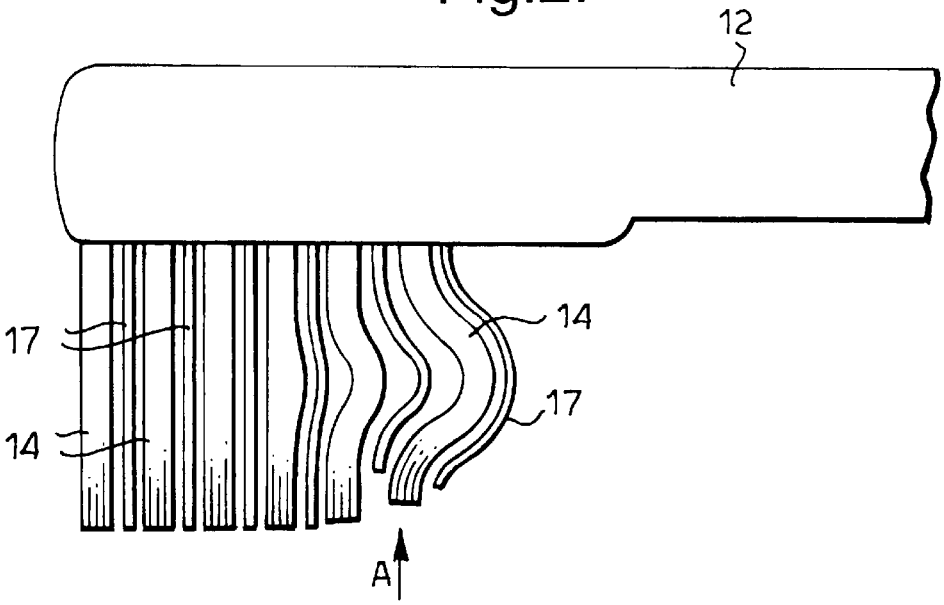
FIG. 2 is a side view of a brush head according to a second embodiment of the invention showing bristles interleaved with piezochromic plates.
Figure 3:
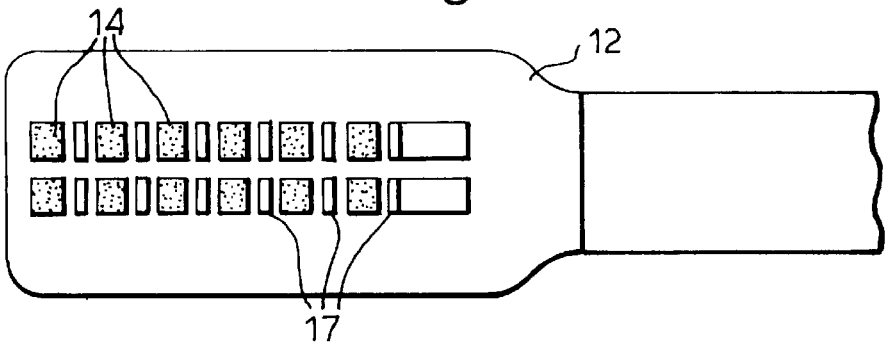
FIG. 3 is a plan view of the brush head of FIG. 2.

FIGS. 2 and 3 show respectively a side and plan view of the head 12 of a second embodiment of the invention to a larger scale. Bristles 14 are interleaved with plates 17 made of piezochromic material liquid crystal cholesterol ester. Pressure on the brush head 12 in the direction of the arrow A causes flexure of the bristles 14 and the plates 17 in the way shown, and this deformation is transmitted to the plates 17 which will cause an optical response such as a change in colour in the piezochromic material should the correct brushing pressure be applied.

Figure 4:
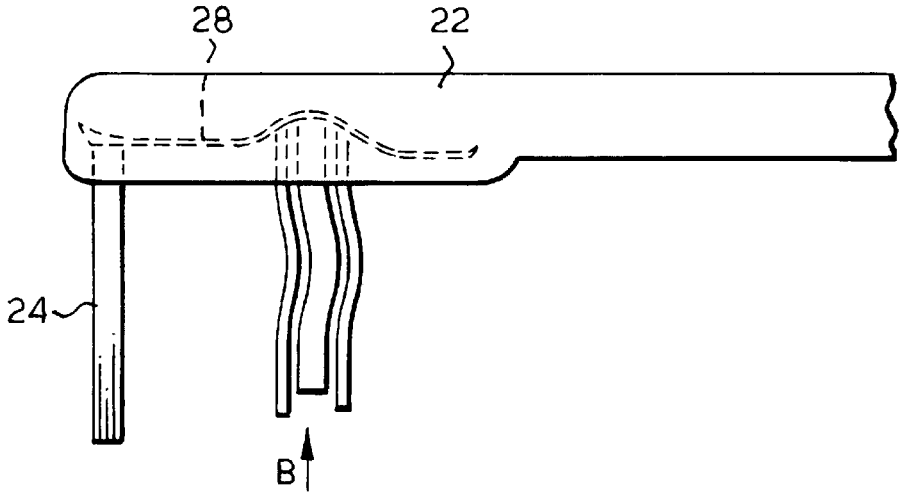
FIG. 4 is a side view of a brush head according to a third embodiment of the invention showing a membrane at the base of a bristle array.

FIG. 4 shows a side view of a third embodiment of the invention, and shows a brush head 22 provided with bristles 24. The base of each bristle 24 is attached to a flexible membrane 28 which contains the piezochromic material liquid crystal cholesterol ester. Pressure applied to the bristles 24 in the direction of the arrow B is transmitted to the membrane 28, and causes it to deform. Deformation of the membrane 28 stresses the piezochromic material contained within it, causing an optical response in the material such as a change of colour on the application of suitable pressure.

Figure 5:
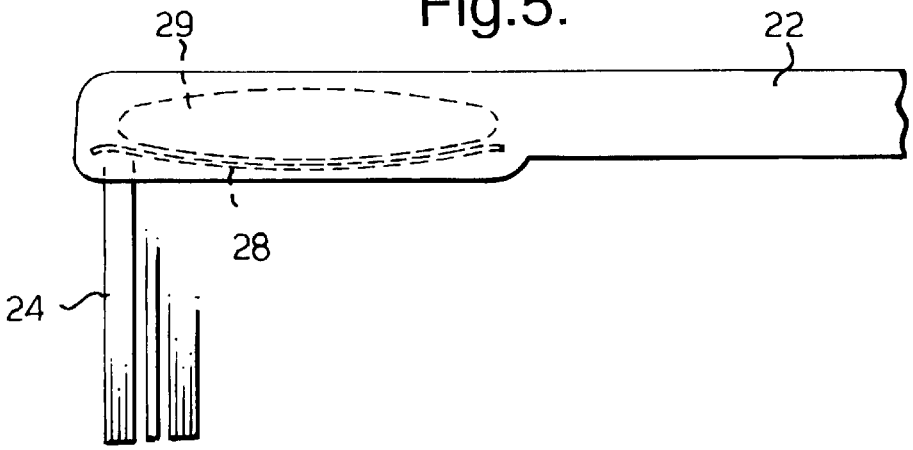
FIG. 5 is a side view of a modified version of the brush head of FIG. 4 showing the membrane replaced by a bubble of piezochromic material.

FIG. 5 shows a modified version of the brush head of FIG. 4, in which piezochromic material is contained in a sac 29. Pressure on the bristles 24 is transmitted to the sac 29 via flexible membrane 28 causing it to deform, thereby causing an optical response in the piezochromic material. In this modified brush head, the membrane 28 does not contain piezochromic material. Indeed, in a further modification, the membrane is not required, in which case pressure on the bristles 24 is transmitted directly to the sac 29.

Figure 6:
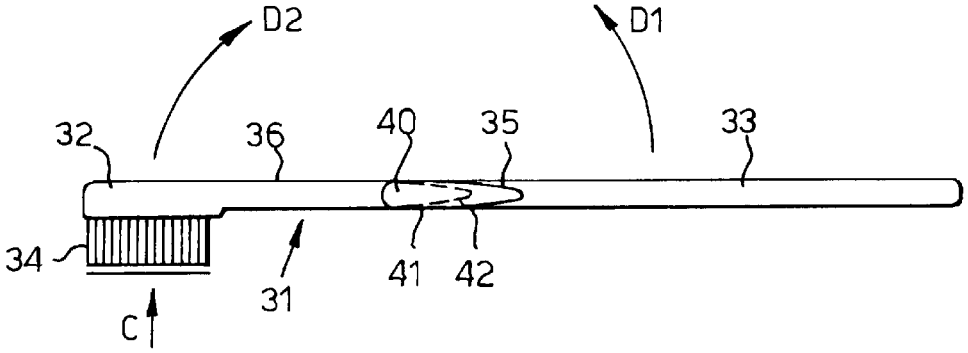
FIG. 6 is a side view of a fourth embodiment of the invention showing two handle sections linked by a pivot.

FIG. 6 shows a side view of a fourth embodiment of the invention, in which a handle 33 and a neck 36 of the brush 31 are pivotally connected at 40. A portion 41 (indicated in dotted lines) of the neck 36 extends beyond the pivot 40 into a cavity 35 formed in the handle 33. The neck 36 is integral with the head 32 of the brush 31.

In this embodiment at least the handle 33 is formed of a transparent plastics material such as polymethyl methacrylate. Pressure applied to the bristles 34 of the brush 31 in the direction of the arrow C, whilst the handle 33 is being held firmly, causes the handle and the head 32 to rotate relative to each other about the pivot 40 in the directions of the arrows D1 and D2.

Rotation is impeded as the neck portion 41 comes into contact with a pad 42 containing a piezochromic material. Continued mechanical pressure on the head 32 of the brush 31 is transmitted to the pad 42 causing an optical response in the piezochromic material.

Figure 7:
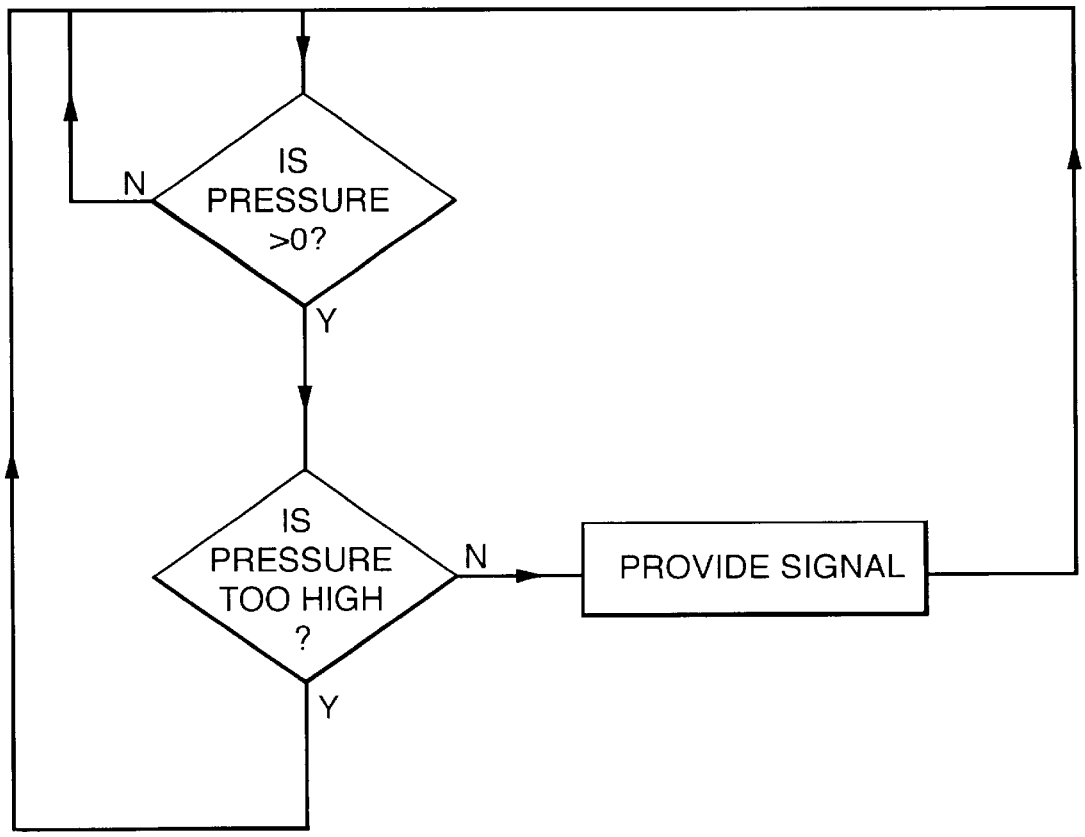
FIG. 7 is a graphical representation of the circuitry of an embodiment according to the invention.

FIG. 7 illustrates the role of the integrated circuit in certain embodiments of the invention. The integrated circuit will receive input from the pressure sensor and by way of a simple logic gate open or close the circuit to the indicator. For example, when brushing pressure is greater than zero the logic gate allows current to flow to the liquid crystal, which may be located in a cell as commonly found in calculator screens, and so provide a signal. As pressure is increased current may be allowed to flow to more cells indicating to the user that pressure is increasing. When pressure reaches an unacceptable level the logic gate closes the circuit to the indicator and the signal is withdrawn.

It will be apparent that modifications could be made to the embodiments described above. In particular, the piezochromic material could be replaced by any material (such as a mechanochromic or thermochromic material) that alters its visual appearance in response to a mechanical strain. For example, a liquid crystal that changes colour when subjected to a mechanical strain could be used.

Alternatively, it is also envisaged that polarised materials will be used, with pieces of polarised material being configured such that their planes of polarisation are at 90° C. to each other. One of the pieces of material is fixed, and the other is able to move on the application of excessive pressure (for example by being attached to a mechanical type embodiment as described in conjunction with FIG. 6 above) such that a different orientation of polarisation planes is achieved, and thereby a colour change is observed. Otherwise, also envisaged is an embodiment of sheet form polarisors which are orientated parallel to each other, and which are separated by an arrangement such as a coiled spring and/or a helical arrangement, whereby the two polarisors are caused to rotate relative to each other when they are brought closer to or further apart from each other in response to changes in brushing pressure. As a result, the polarisors adopt a different configuration relative to each other, and a colour change is observed.

What is claimed is:

1. A toothbrush incorporating an indicator comprising a pressure indicating material, which provides a signal without the provision of a power supply, characterized in that the indicator is capable of providing a signal selected from the group consisting of optical, audible and mechanical signals, the signal being visually or audibly observable by a toothbrush user only when a suitable brushing pressure is being applied.

2. A toothbrush according to claim 1, wherein the signal is provided when a suitable brushing pressure is being applied and is absent when brushing pressure is too high.

3. A toothbrush according to claim 1, wherein the pressure indicating material is a piezochromic material.

4. A toothbrush according to claim 3, wherein the piezochromic material is a shear sensitive material.

5. A toothbrush according to claim 3, wherein the piezochromic material is liquid crystal cholesterol ester.

6. A toothbrush according to claim 1, wherein the toothbrush comprises a handle, a neck, and a head, any of which may be manufactured of a clear material, the handle, head or neck having a cavity in which the pressure indicating material is located.

7. A toothbrush according to claim 6, wherein the toothbrush comprises a membrane or sac of pressure indicating material in the head to indicate the pressure applied.

8. A toothbrush according to claim 1, wherein the toothbrush contains mechanical means by which pressure is applied to the pressure indicating material to thereby generate the optical signal.

9. A toothbrush according to claim 1, wherein the pressure indicating material has a relaxation period of between 1 second and 24 hours.

10. A toothbrush according to claim 1, wherein the pressure indicating material has a relaxation period of between 1 second and 10 minutes.

11. A toothbrush according to claim 1, wherein the pressure indicating material has a relaxation period of between 1 second and 5 seconds.

12. A toothbrush according to claim 1 which in use provides the user with an optical response which is a color change in response to suitable brushing pressure by the user.

* * * * *